US005385162A

United States Patent [19]

Wu

[11] Patent Number: 5,385,162

[45] Date of Patent: Jan. 31, 1995

[54] UMBRELLA HAVING AUTOMATICALLY CLOSED WATER COLLECTOR

[76] Inventor: Tsun-Zong Wu, P. O. Box 55-1670, Taipei,

[21] Appl. No.: 148,564

[22] Filed: Nov. 8, 1993

[51] Int. Cl.[6] ..... A45B 25/28

[52] U.S. Cl. ..... 135/48; 135/34.2

[58] Field of Search ..... 135/33.2, 48 OR, 34.2, 135/44

[56] References Cited

U.S. PATENT DOCUMENTS

| | | | |
|---|---|---|---|
| 4,703,768 | 11/1987 | Lee | 135/48 |
| 5,135,017 | 8/1992 | Fujiyama | 135/34.2 |
| 5,161,560 | 11/1992 | Sheu | 135/48 |
| 5,178,175 | 1/1993 | Lin | 135/48 |
| 5,195,550 | 3/1993 | Chan | 135/48 |

FOREIGN PATENT DOCUMENTS

| | | | |
|---|---|---|---|
| 0185947 | 10/1906 | Germany | 135/48 |
| 2248181 | 4/1992 | United Kingdom | 135/48 |

*Primary Examiner*—Carl D. Friedman
*Assistant Examiner*—Wynn E. Wood

[57] ABSTRACT

An umbrella includes a plurality of telescopic sleeves telescopically extendibly and retractibly mounted on an umbrella shaft covered with umbrella cloth, a water collector secured on a tip portion of the umbrella communicating with interior of the telescopic sleeves for collecting rain water drained from the umbrella cloth, and a drain valve slidably held on the water collector and operatively pushed by an innermost or smallest sleeve for automatically closing a plurality of drain holes formed in a lower portion of the water collector to prevent unexpected dripping of the rain water as stored in the collector for hygienic purpose.

10 Claims, 5 Drawing Sheets

UMBRELLA HAVING AUTOMATICALLY CLOSED WATER COLLECTOR

BACKGROUND OF THE INVENTION

U.S. Pat. No. 5,135,017 to Taiji Fujiyama disclosed an umbrella cover Which is fixed to a top end of an umbrella shaft for covering an outer circumference of an umbrella cloth when the umbrella is closed, capable of keeping the umbrella cloth protected and waterproof for preventing dripping of rain water. However, such an umbrella cover still has the following defects:

1. When the water drain cap 23 of a closed umbrella is pulled downwardly to discharge rain water stored in the chamber 10 through the drain ports 20, the cap 23 should be depressed upwardly to re-close the drain ports 20. If forgetting to re-close the cap 23, the rain water may be accidentally drained from the umbrella tip to an umbrella user who grasps the umbrella handle when inverting a closed umbrella for facing the umbrella tip upwardly ready for an opening use, thereby possibly wetting or contaminating the user or the other objects.

2. An umbrella shaft fixing cylinder 9 formed as a cup-like structure should be provided at one end of the sliding cylinder 8 to guide drain water downwardly through the water drip passing port 16, thereby increasing installation complexity and production cost therefor.

3. The cap 23 is of a double cylinder structure having a cylindrical rib 24 projected at a central part thereof. As shown in his drawing FIGS. 12, 13, there is always stored with rain water in the cylindrical rib 24 like a "dead pool", easily growing bacteria or fungi or being easily mildewed to thereby influence environmental hygiene.

The present inventor has found the defects of the conventional umbrella cover and invented the present umbrella having rain-water collector for automatically closing its drain valve.

SUMMARY OF THE INVENTION

The object of the present invention is to provide an umbrella including a plurality of telescopic sleeves telescopically extendibly and retractibly mounted on an umbrella shaft covered with umbrella cloth, a water collector secured on a tip portion of the umbrella communicating with interior of the telescopic sleeves for collecting rain water drained from the umbrella cloth, and a drain valve slidably held on the water collector and operatively pushed by an innermost or smallest sleeve for automatically closing a plurality of drain holes formed in a lower portion of the water collector to prevent unexpected dripping of the rain water as stored in the collector for hygienic purpose.

DETAILED DESCRIPTION

Figure 2:
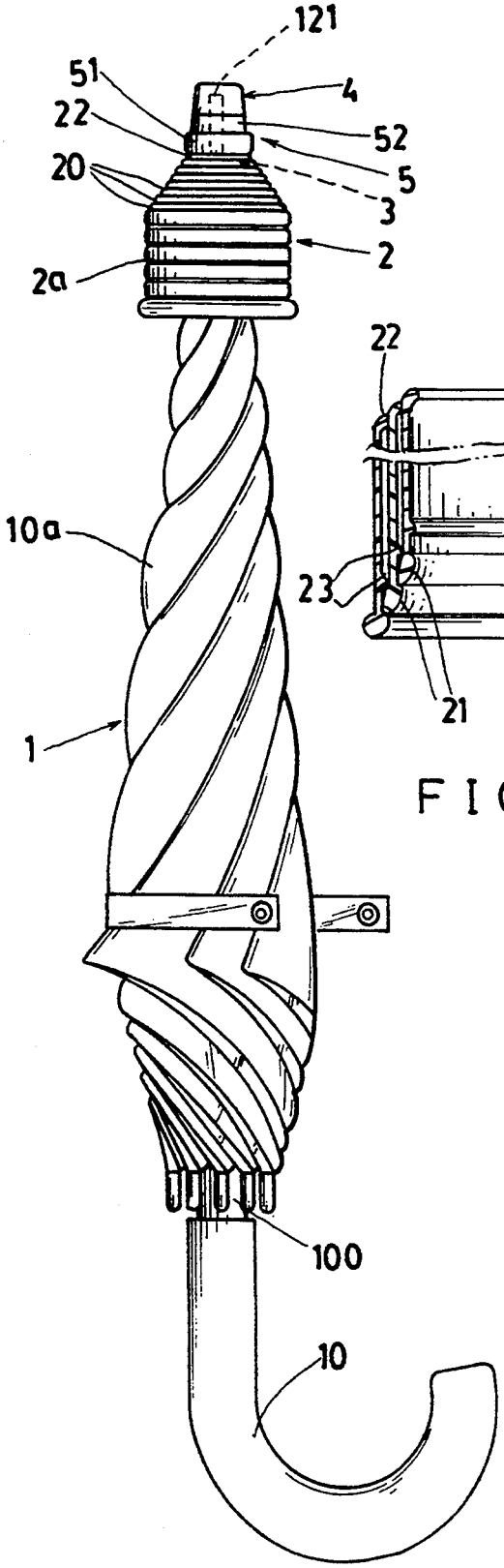
FIG. 2 shows the folded umbrella with its tip portion facing upwardly.
Figure 2A:
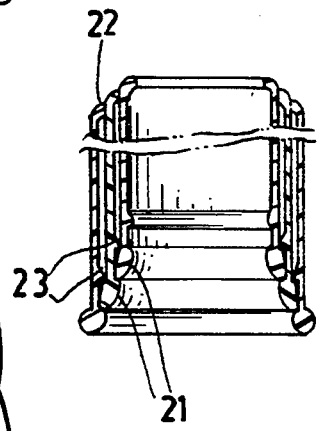
FIG. 2*a* is an illustration showing the folded sleeve members engaged with one another.
Figure 1:
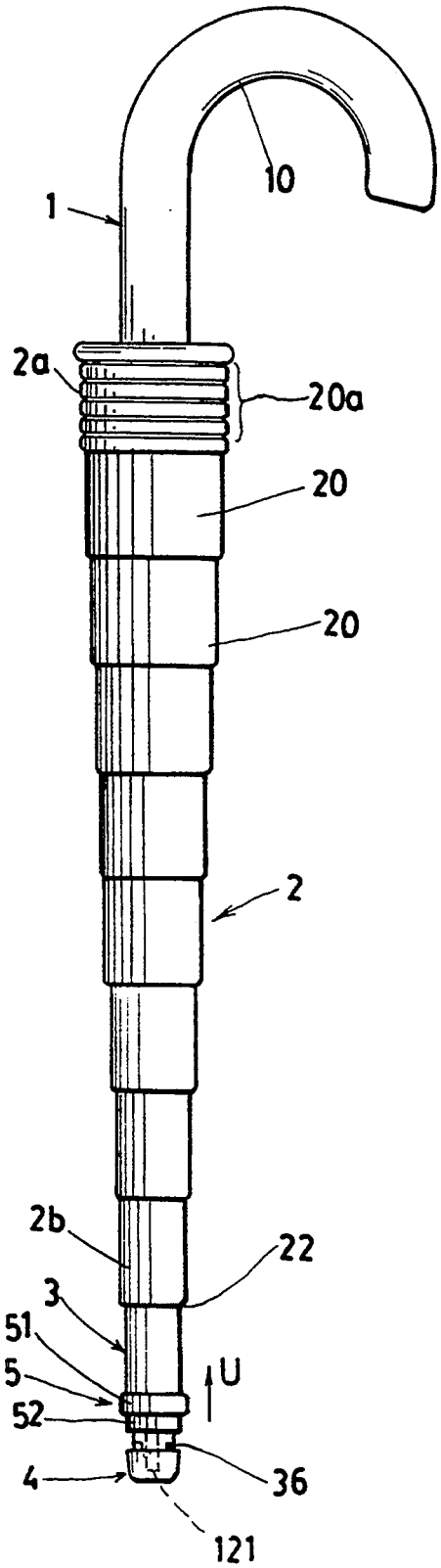
FIG. 1 is an illustration showing a folded umbrella of the present invention with a tip portion facing downwardly by opening a drain valve.

As shown in FIGS. 1–9, the present invention comprises: an umbrella 1 having a telescopic sleeve means 2 telescopically mounted on the umbrella 1, a water (rain water) collector 3 secured on a tip portion 12 of the umbrella 1, and an end cap 4 secured on an end portion of the water collector 3 or a tip end portion 121 of the umbrella 1 for limiting a drain valve 5 slidably held on the water collector 3.

The telescopic sleeve means 2 includes: a plurality of sleeve members 20 telescopically extendibly or retractibly mounted on the umbrella 1 having an umbrella cloth 10*a* covering an umbrella shaft 100 having a handle 10 formed on an upper portion of the umbrella shaft 100 and a tip portion 12 opposite to the handle 10 when facing the tip portion 12 downwardly towards a ground surface (not shown), with the plurality of sleeve members 20 gradually tapered downwardly from the handle 10 towards the tip portion 12 of the umbrella 1 and operatively extended to cover the umbrella cloth 10*a* or retracted to rest on the tip portion 12 of the umbrella 1 of which a conical ferrule 11 is provided to fasten a central portion of the umbrella cloth 10*a* to the tip portion 12 of the umbrella 1, and a tip end portion 121 secured with the water collector 3, having a largest sleeve member 2*a* adjacent to the handle 10 formed with corrugated surface 20*a* on the largest sleeve member 2*a* for frictionally grasping the sleeve member 20*a* for telescopically extending or retracting the plurality of sleeve members 20, and a smallest sleeve member 2*b* adjacent to the water collector 3 secured on the tip portion 12 of the umbrella 1.

Each sleeve member 20 has a large flange ring 21 circumferentially formed on an upper periphery of each said sleeve member 20 when facing the tip portion 12 of the umbrella downwardly to a ground surface, a small flange rim 22 circumferentially formed on a lower periphery of the sleeve member 20, and a taper annular extension 23 annularly formed inside the sleeve member 20 adjacent to and positioned under the large flange ring 21 when facing the tip portion 12 of the umbrella 1 downwardly, each said large flange ring 21 of a lower (smaller) sleeve member 20 engageable with a small flange rim 22 of an upper neighbouring (larger.) sleeve member 20 when operatively extending the plurality of sleeve members 20 for covering the umbrella cloth 10*a* when facing the tip portion 12 of the umbrella downwardly; and each said taper annular extension 23 of an upper (small) sleeve member 20 engageable with a larger flange ring 21 of a lower (larger) sleeve member 20 when operatively retracting the sleeve members 20 and facing the tip portion 12 upwardly ready for (next) opening the umbrella as shown in FIG. 2, thereby stabilizing the sleeve members 20 under folded retracted state as shown in FIG. 2.

The telescopic structure of the plural sleeve members 20 may be a conventional telescopic mechanism which can be modified by those skilled in the art.

Figure 6:
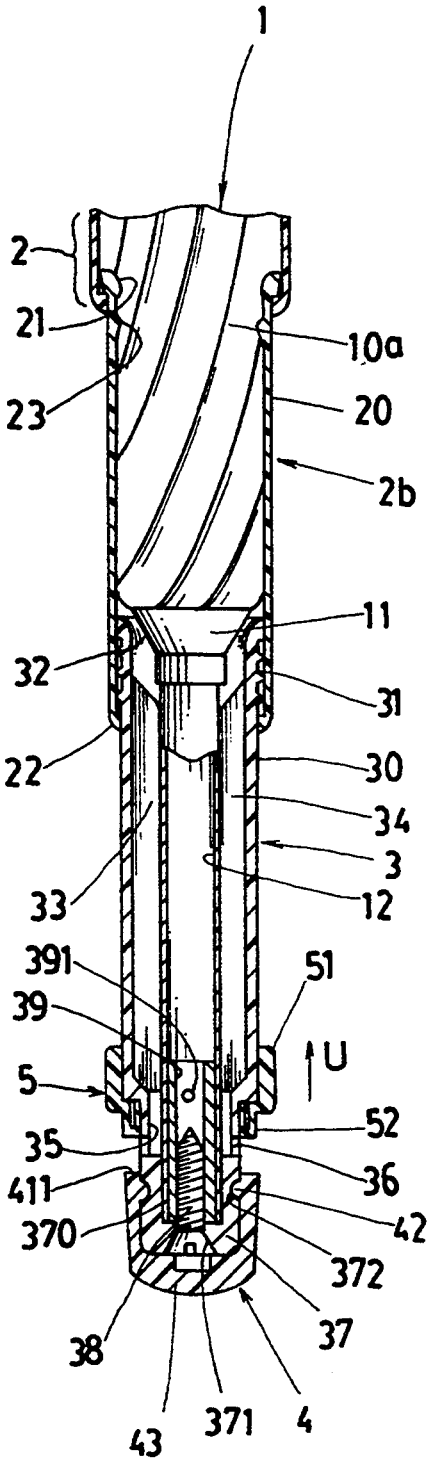
FIG. 6 shows an opened drain valve of the present invention.
Figure 5:
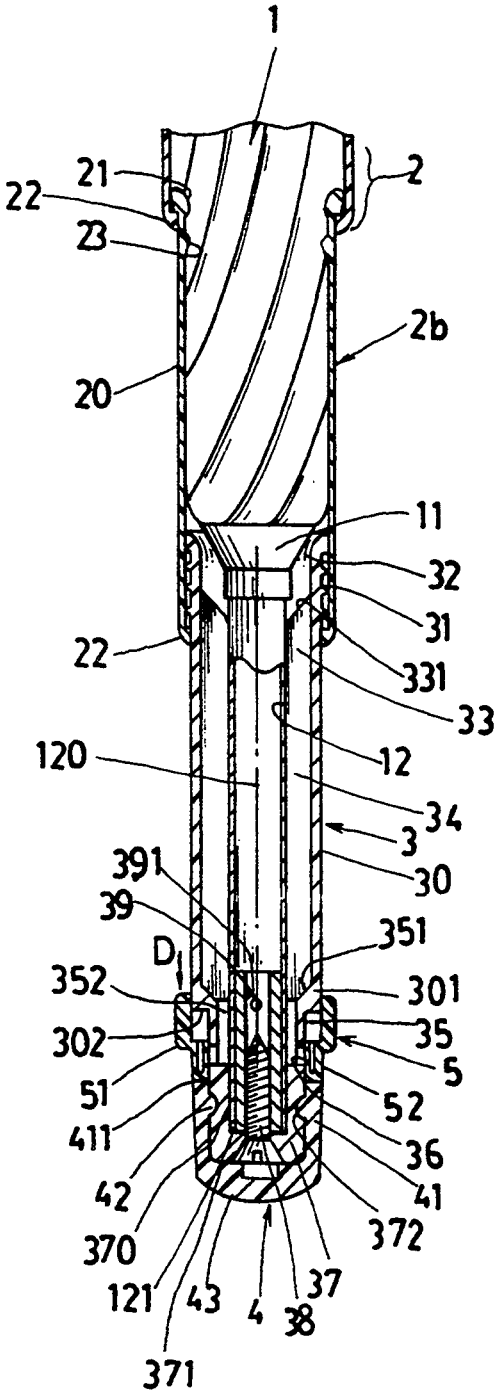
FIG. 5 is a sectional drawing showing a closed drain valve of the present invention.
Figure 7:
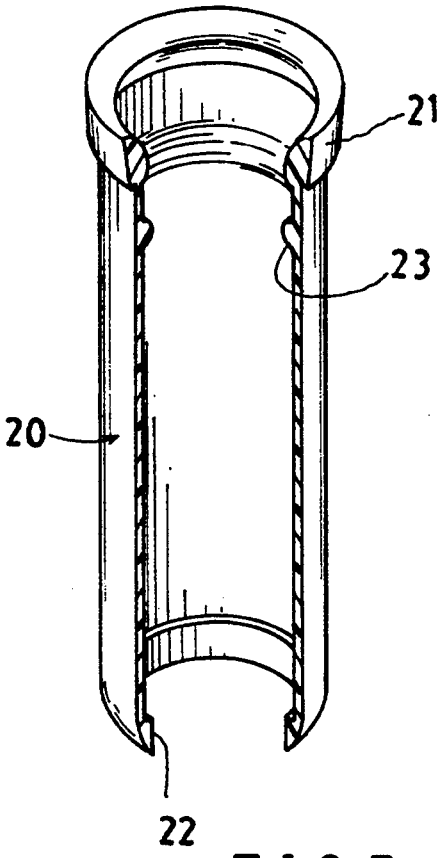
FIG. 7 is an illustration showing a sleeve member of the present invention.
Figure 9:
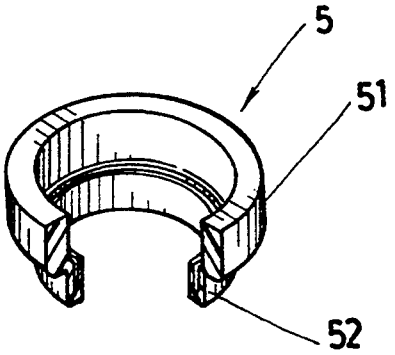
FIG. 9 shows a drain valve of the present invention.
Figure 8:
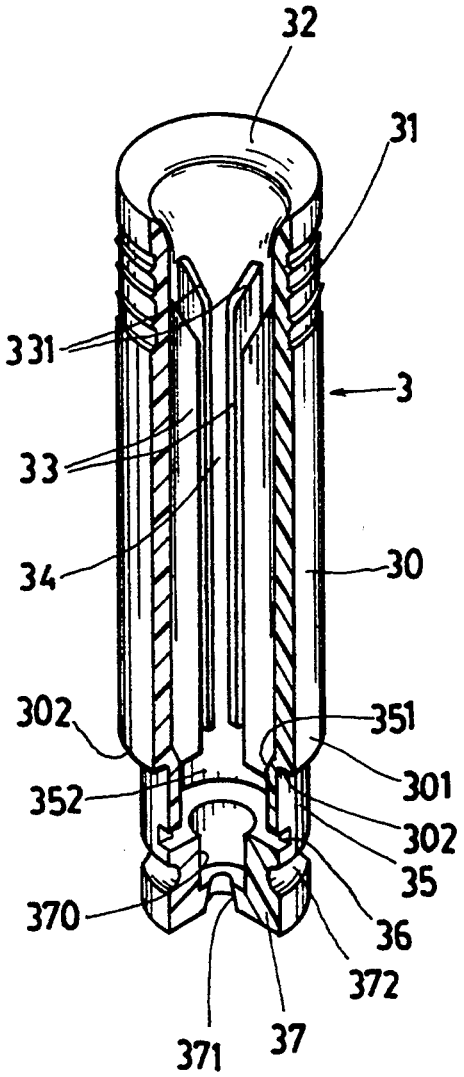
FIG. 8 is a perspective view of the water collector of the present invention.

The water collector 3 includes: a main cylindrical portion 30 having a plurality of packing ring extensions 31 concentrically formed on an upper portion of the main cylindrical portion 30 for firmly engaging (also for sealing) a tapered lower portion of a lowest or smallest sleeve member **2*b* of the plurality of sleeve members 20 when facing the tip portion 12 of the umbrella 1 downwardly as shown in FIGS. 5, 6 and 8, a water inlet port 32 formed on an upper portion in the main cylindrical portion 30 for draining rain water drops from inside the sleeve members 20 and the umbrella cloth 10*a* into a water chamber confined within the main cylindrical portion 30, a plurality of radial blades 33 each blade 33 longitudinally secured to an inside wall of the main cylindrical portion 30 and protruding radially inwardly towards the tip portion 12 of the umbrella 1 to be firmly retained on the tip portion 12 of the umbrella, a contracted cylindrical portion 35 contracted downwardly from the main cylindrical portion 30 for slidably holding the drain valve 5 thereon for sealing or opening a plurality of drain holes 36 formed in the contracted cylindrical portion 35, a collector bottom portion 37 formed on a bottom portion of the water collector 3 to be fixed on a tip end portion 121 of the umbrella 1 by a fixing member 38** selected from a screw, a pin, a latch, etc.

Each of the plurality of radial blades 33 has a slope guide portion 331 formed on an upper portion of each blade 33 inclined inwardly downwardly towards an axis 120 of the tip portion 12 of the umbrella 1 for smoothly inserting the water collector 3 onto the tip portion 12 of the umbrella 1.

The collector bottom portion 37 has an annular groove 372 circumferentially recessed in a cylindrical surface of the collector bottom portion 37 to be engaged with an annular extension 42 circumferentially formed on a cylindrical wall portion 41 of an end cap 4 having a bottom cap portion 43 for capping the collector bottom portion 37, the end cap 4 having a cap shoulder portion 411 formed on an upper surface of the cylindrical wall portion 41 of the end cap 4 for seating the drain valve 5 (FIG. 5) when downwardly moved for closing the drain holes 36 of the water collector 3.

The water collector 3 has a collector shoulder portion 302 annularly formed on a bottom portion of a lower cylindrical portion 301 of the main cylindrical portion 30 of the water collector 3, the collector shoulder portion 302 retarding an upward movement of the drain valve 5 when opening the drain holes 36 of the water collector 3 as shown in FIG. 6.

The contracted cylindrical portion 35 has a conical portion formed in a lower portion of the water chamber 34 for smoothly discharging rain water stored in the chamber 34 into a discharging chamber 352 communicating with the drain holes 36 and the water chamber 34.

The collector bottom portion 37 has a tip hole 370 for engaging the tip end portion 121 of the umbrella, and a fixing hole 371 for passing the fixing member 38 therethrough, said fixing member 38 securing the collector bottom portion 37 of the collector 3 to the tip portion 12 of the umbrella by inserting the fixing member 38 into an inner plug 39 which is secured by a pin 391 in the tip portion 12 made as a hollow tube.

Figure 10:
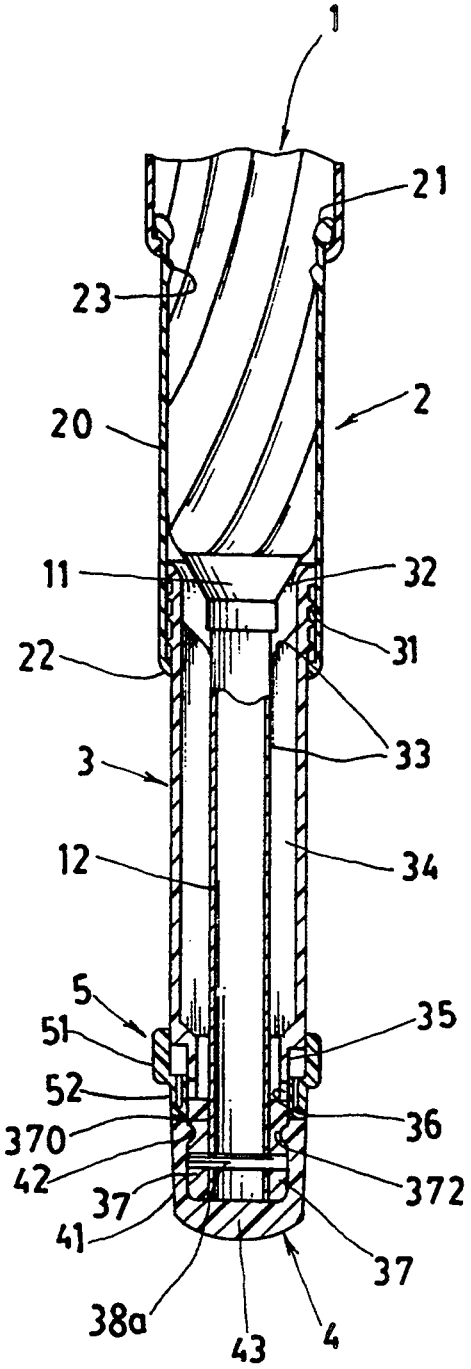
FIG. 10 shows another preferred embodiment of the present invention.

The inner plug 39 may be omitted as shown in FIG. 10, wherein a fixing member of a fixing pin 38a is diametrically inserted through the collector bottom portion 37 and the tip portion 12 of the umbrella for securing the water collector 3 on the tip portion 12 of the umbrella.

The drain valve 5 includes a cylindrical skirt portion 51 upwardly protruding from an elastic sealing collar 52, the sealing collar 52 slidably held on the contracted cylindrical portion 35 of the water collector 3, with the cylindrical skirt portion 51 radially protruding outwardly to be impacted by the sleeve members 20 and slidably engageable with a lower cylindrical portion 301 of the main cylindrical portion 30 of the water collector 3, whereby upon upwardly moving of the sealing member 52 to open the drain holes 36, the rain water collected in the chamber 34 will be discharged outwardly; and upon downwardly moving of the sealing member 52 as pushed by a flanges rim 22 of a tip-side sleeve member **2*b* to close the drain holes 36, the rain water will be kept fin the collector 3** without wetting or contaminating the surroundings.

The elastic sealing member 52 is integrally formed with the cylindrical skirt portion 51 of the drain valve, having a longitudinal section of generally U shape for exerting elasticity of the sealing member 52 to be resiliently retained on the contracted cylindrical portion 35 of the water collector 3 for well sealing the drain holes 36.

When pushing the skirt portion 51 of the drain valve 5 upwardly (U) as shown in FIG. 6, the water in the collector 3 as drained from the sleeve means 2 and the umbrella cloth **10*a*** will be discharged outwardly thoroughly without contaminating the surroundings.

Figure 3:
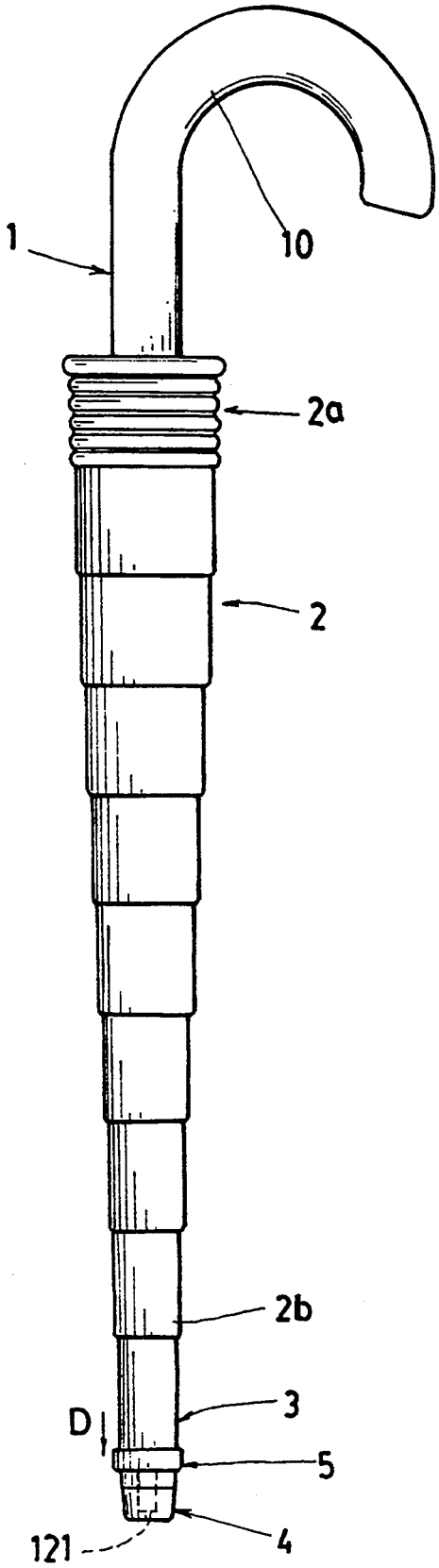
FIG. 3 shows the folded umbrella by closing the drain valve.
Figure 4:
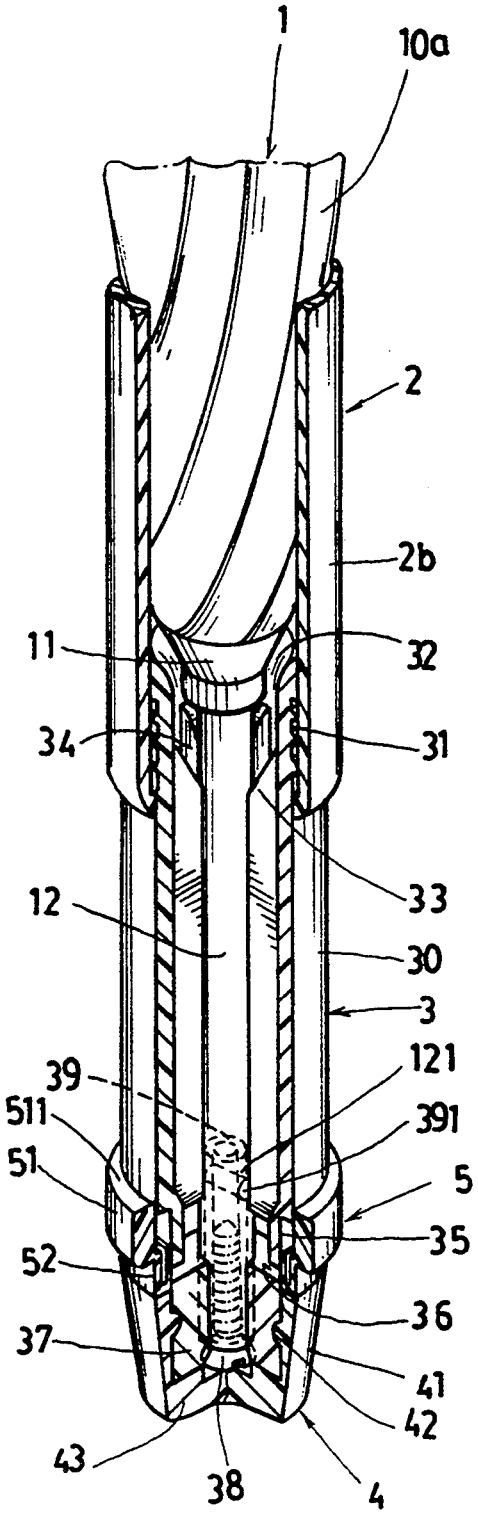
FIG. 4 is a partial cut-away illustration of the present invention.

When retracting the sleeve members 20 as shown in FIGS. 2, 3, 5, the skirt portion 51 of the drain valve 5 will be automatically pushed frontwardly by the flange rim 22 of the smallest sleeve member **2*b* which is urged by the other sleeve members 20 telescopically engageable with one another towards the tip end portion 121 of the umbrella 1, thereby ensuring an automatically closing of the drain valve 5 even forgetting to manually close the valve 5**. This is the most advantageous improvement over the prior art such as disclosed by the Fujiyama. Meanwhile, this invention provides a simpler structure of rain water collecting device for an umbrella.

I claim:

1. An umbrella comprising:

a telescopic sleeve means 2 including a plurality of sleeve members 20 telescopically extendibly and retractibly mounted on an umbrella shaft 100 covered with an umbrella cloth **10*a* on the shaft, said plurality of sleeve members 20 gradually tapered in diameters from a handle 10 of the umbrella shaft towards a tip portion 12 of said umbrella shaft for shielding the umbrella cloth 10*a*** when extended;

a water collector 3 secured on said tip portion 12 of said umbrella shaft 100;

a drain valve 5 slidably held on said water collector 3 for sealing a plurality of drain holes 36 formed in a lower portion of said water collector 3 when facing the tip portion 12 downwardly towards a ground surface, said drain valve 5 operatively pushed towards a tip end portion 121 of said umbrella shaft by said telescopic sleeve means 2 to automatically close the drain holes 36 in said water collector 3 when retracting said sleeve members 20 of said telescopic sleeve means 2 towards the tip portion 12 of the umbrella ready for opening an umbrella for a next use; and an end cap 4 capping a bottom portion of said water collector 3 and said tip portion 12 of said umbrella 1.

2. An umbrella according to claim 1, wherein said water collector 3 includes: a main cylindrical portion 30 having a plurality of packing ring extensions 31 concentrically formed on an upper portion of the main cylindrical portion 30 for firmly engaging a tapered lower portion of a lowest sleeve member 2*b* of the plurality of sleeve members 20 when facing the tip portion 12 of the umbrella 1 downwardly, a water inlet port 32 formed on an upper portion in the main cylindrical portion 30 for draining rain water drops from inside the sleeve members 20 and the umbrella cloth 10*a* into a water Chamber 34 confined within the main cylindrical portion 30, a plurality of radial blades 33 each blade 33 longitudinally secured to an inside wall of the main cylindrical portion 30 and protruding radially inwardly towards the tip portion 12 of the umbrella 1 to be firmly retained on the tip portion 12 of the umbrella, a contracted cylindrical portion 35 contracted downwardly from the main cylindrical portion 30 for slidably holding the drain valve 5 thereon for sealing or opening a plurality of drain holes 36 formed in the contracted cylindrical portion 35, a collector bottom portion 37 formed on a bottom portion of the water collector 3 to be fixed on a tip end portion 121 of the umbrella 1 by a fixing member 38.

3. An umbrella according to claim 2, wherein each said radial blade 33 has a slope guide portion 331 formed on an upper portion of said blade 33 inclined inwardly downwardly towards an axis 120 of the tip portion 12 of the umbrella 1 for smoothly inserting the water collector 3 onto the tip portion 12 of the umbrella.

4. An umbrella according to claim 2, wherein said collector bottom portion 37 has an annular groove 372 circumferentially recessed in a cylindrical surface of the collector bottom portion 37 to be engaged with an annular extension 42 circumferentially formed on a cylindrical wall portion 41 of an end cap 4 having a bottom cap portion 43 for capping the collector bottom portion 37, the end cap 4 having a cap shoulder portion 411 formed on an upper surface of the cylindrical wall portion 41 of the end cap 4 for seating the drain valve 5 when downwardly moved for closing the drain holes 36 of the water collector 3 of the umbrella having the tip portion facing downwardly.

5. An umbrella according to claim 4, wherein said water collector 3 has a collector shoulder portion 302 annularly formed on a bottom portion of a lower cylindrical portion 301 of the main cylindrical portion 30 of the water collector 3, the collector shoulder portion 302 operatively retarding an upward movement of the drain valve 5 when opening the drain holes 36 of the water collector.

6. An umbrella according to claim 2, wherein said contracted cylindrical portion 35 has a conical portion formed in a lower portion of the water chamber 34 for smoothly discharging rain water stored in the chamber 34 into a discharging chamber 352 communicating with the drain holes 36 and the water chamber 34.

7. An umbrella according to claim 2, wherein said collector bottom portion 37 has a tip hole 370 for engaging the tip end portion 121 of the umbrella, and a fixing hole 371 for passing the fixing member 38 therethrough, said fixing member 38 securing the collector bottom portion 37 of the collector 3 to the tip portion 12 of the umbrella by inserting the fixing member 38 into an inner plug 39 which is secured by a pin 391 to the tip portion 12.

8. An umbrella according to claim 2, wherein said water collector has a fixing member made as a fixing pin 38*a* diametrically inserted through the collector bottom portion 37 and the tip portion 12 of the umbrella for securing the water collector 3 on the tip portion 12 of the umbrella.

9. An umbrella according to claim 2, wherein said drain valve 5 includes a cylindrical skirt portion 51 upwardly protruding from an elastic sealing collar 52, the sealing collar 52 slidably held on the contracted cylindrical portion 35 of the water collector 3, with the cylindrical skirt portion 51 radially protruding outwardly to be impacted by a plurality of said sleeve members 20 and slidably engageable with a lower cylindrical portion 301 of the main cylindrical portion 30 of the water collector 3, whereby upon upwardly moving of the sealing member 52 to open the drain holes 36, the rain water collected in the chamber 34 will be discharged outwardly; and upon downwardly moving of the sealing member 52 as pushed by a flange rim 22 of a smallest sleeve member 2*b* adjacent to the tip portion 12 to close the drain holes 36, the rain water will be kept in the collector without wetting the surroundings.

10. An umbrella according to claim 9, wherein said elastic sealing member 52 is integrally formed with the cylindrical skirt portion 51 of the drain valve, having a longitudinal section of generally U shape for exerting elasticity of the sealing member 52 to be resiliently retained on the contracted cylindrical portion 35 of the water collector 3 for well sealing the drain holes 36.

* * * * *